United States Patent [19]

Furse et al.

[11] Patent Number: 4,660,657

[45] Date of Patent: Apr. 28, 1987

[54] UNDERREAMER

[75] Inventors: John H. Furse; Praful C. Desai, both of Kingwood; Charles H. Dewey, Houston, all of Tex.

[73] Assignee: Smith International, Inc., Newport Beach, Calif.

[21] Appl. No.: 789,388

[22] Filed: Oct. 21, 1985

[51] Int. Cl.[4] ..... E21B 10/34

[52] U.S. Cl. ..... 175/269

[58] Field of Search ..... 175/269, 267, 272, 274, 175/286, 291, 292

[56] References Cited

U.S. PATENT DOCUMENTS

| | | | |
|---|---|---|---|
| 384,625 | 6/1888 | Herberg | 175/267 |
| 2,069,482 | 2/1937 | Seay | 175/269 |
| 2,177,721 | 10/1939 | Johnson et al. | 175/243 |
| 2,344,598 | 3/1944 | Church | 175/286 |
| 3,552,509 | 1/1971 | Brown | 175/268 |
| 3,712,854 | 1/1973 | Thometz | 175/269 |
| 3,749,187 | 7/1973 | Leathers | 175/269 |
| 3,817,339 | 6/1974 | Furse | 175/271 |
| 3,949,820 | 4/1976 | Furse | 175/286 |
| 4,282,941 | 8/1981 | Perkin | 175/269 X |
| 4,565,252 | 1/1986 | Campbell et al. | 175/269 |

FOREIGN PATENT DOCUMENTS 401721 11/1933 United Kingdom ..... 175/269

*Primary Examiner*—Stephen J. Novosad
*Assistant Examiner*—Thuy M. Bui
*Attorney, Agent, or Firm*—Christie, Parker & Hale

[57] ABSTRACT

This underreamer has a lower body and a tubular upper body connected above it. A pair of extendible cutter arms are scissored in the lower body for pivoting between retracted and extended positions. A sleeve fixed to the lower body extends upwardly within the upper body with an outside diameter smaller than the inside diameter of the upper body to leave a fluid flow annulus between the sleeve and upper body. A piston in the sleeve is axially movable from an upward position toward a lower position in response to application of fluid pressure through a drill string for pivoting the cutter arms from the retracted position toward the extended position. Passages through the lower body convey drilling fluid through the lower body from the annulus between the upper body and the sleeve. Such fluid is discharged outside the lower body adjacent to cutters on the cutter arms, into a pocket in the lower body occupied by the cutters in their retracted position, and through the lower end of the lower body.

14 Claims, 4 Drawing Figures

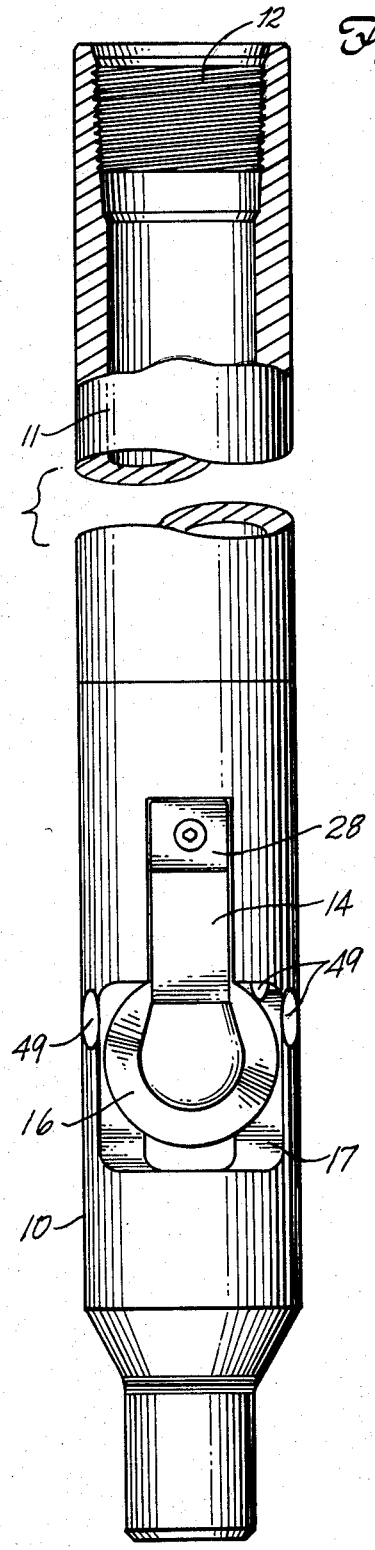
Fig. 1
Fig. 3
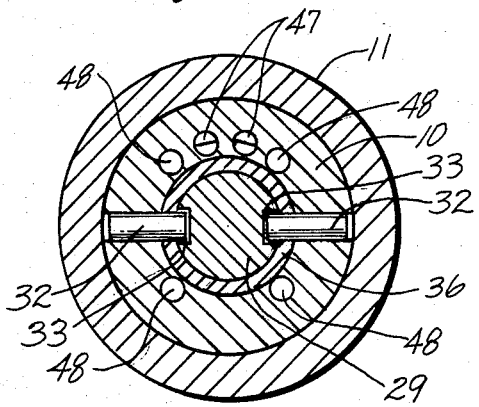
Fig. 4
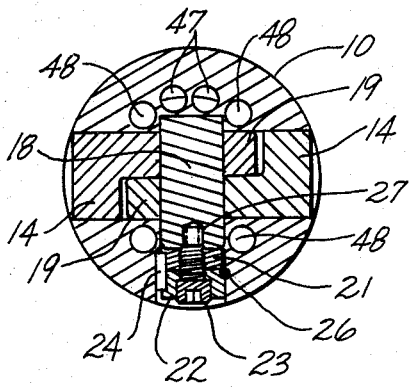

UNDERREAMER

FIELD OF THE INVENTION

This invention relates to an expandable underreamer for enlarging a subsurface portion of an oil well bore or the like.

BACKGROUND

It is often desirable in drilling oil wells to enlarge the diameter of the hole being drilled at some substantial distance below the surface. This may be needed, for example, to provide a sufficient annulus between casing and the formation being drilled to permit cementing the casing in place in the hole.

When this is desired, an expandable underreamer is lowered through the well with its cutter arms retracted. At the desired elevation, the arms are extended and the diameter of the hole is reamed to be larger than the hole through which the underreamer was lowered. When the desired length of hole has been reamed, the arms are retracted and the underreamer withdrawn from the hole.

A variety of underreamers have been designed for this purpose. In some of them the arms are moved from their retracted to their extended position by application of hydraulic pressure as drilling mud is pumped down the drill string supporting the underreamer. In others the arms are extended by weight of the drill string when the assembly including the underreamer is set down against the bottom of the hole. The underreamer described in U.S. Pat. Nos. 3,817,339 and 3,949,820 is exemplary of such an underreamer. The subject matter of these patents is hereby incorporated by reference.

The patented underreamer is desirable for a number of reasons. It has two extendible arms instead of the usual three, which means that the arms and body can be stronger and larger cutters can be mounted on the arms. This can mean that a harder rock formation can be reamed, or that the rate of penetration of the underreamer may be greater, or the underreamer drills further since larger bearings and slower speeds increase drilling life. The patented underreamer provides for flow of fluid past the cutter arms so that a drill bit or the like can be placed below the underreamer and a hole concurrently drilled and reamed.

As mentioned, this underreamer uses set down weight for actuating the extendible arms. It is desirable for greater versatility to extend the arms by application of hydraulic pressure of drilling mud. It is desirable to obtain this advantage without impact on the other advantages this underreamer has.

BRIEF SUMMARY OF THE INVENTION

There is, therefore, provided in practice of this invention according to a presently preferred embodiment, an underreamer having a lower body and a tubular upper body connected above the lower body. At least a pair of extendible cutter arms are mounted in the lower body for pivoting between a retracted position and an extended underreaming position. A sleeve is fixed to the lower body and extends upwardly within the upper body, with at least a portion of the sleeve having an outside diameter smaller than the inside diameter of the upper body to leave an annulus between the sleeve and upper body. A piston in the sleeve is axially shiftable from an upper position to a lower position in response to application of fluid pressure through a drill string connected to the upper body. Shifting of the piston toward the lower position pivots the cutter arms from the retracted position toward the extended position. Passages through the lower body convey drilling fluid through the lower body from the annulus between the upper body and the sleeve. Such an arrangement permits fluid flow around the piston instead of through the piston, as is common in many underreamers.

DRAWINGS

These and other features and advantages of the present invention will be appreciated as the same becomes better understood by reference to the following detailed description when considered in connection with the accompanying drawings wherein:

FIG. 1 is a side view of the underreamer partly cut away to a longitudinal cross section at its upper end;

FIG. 3 is a transverse cross section at line 3—3 of FIG. 2; and

FIG. 4 is a transverse cross section at line 4—4 of FIG. 2.

DESCRIPTION

Figure 2:
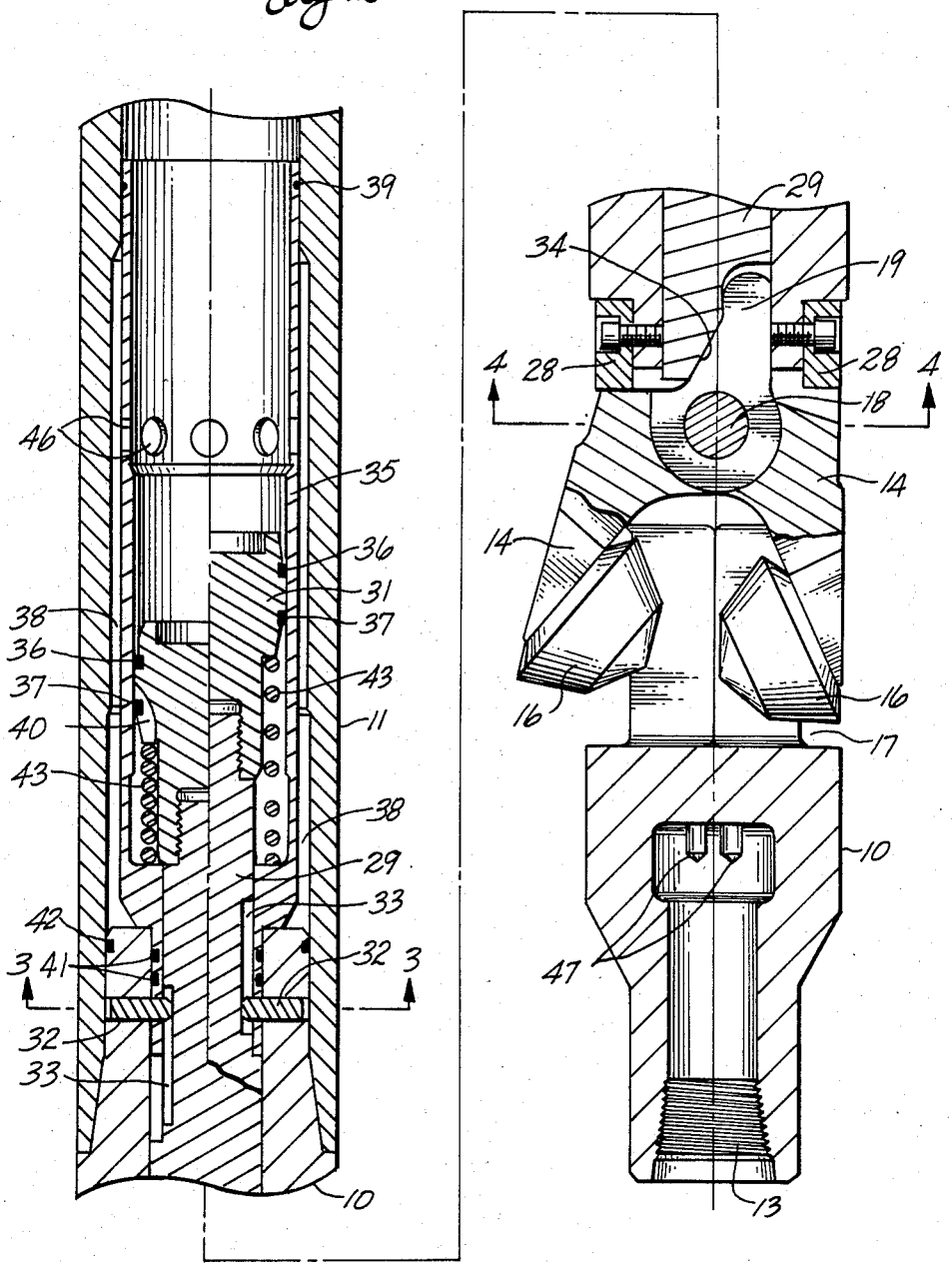
FIG. 2 is a longitudinal cross section of the underreamer ninety degrees from the side view of FIG. 1.

The underreamer provided in practice of this invention has a lower body 10 threaded into a tubular upper body 11. The upper body has a conventional threaded "box" 12 at its upper end for connection of the underreamer to a drill string. The underreamer may be connected to drill pipe, a drill collar, a stabilizer, or a centralizer immediately above it in the drill string. Likewise, the lower body has a threaded box 13 at its lower end. A conventional drill bit, bullnose or the like can thereby be connected below the underreamer.

A pair of pivotable cutter arms 14 are mounted in the lower body for pivoting between a retracted position and an extended underreaming position. A generally conical cutter 16 is mounted on each of the cutter arms. These cutters are indicated schematically in the drawings and it will be understood that they have milled teeth, cemented tungsten carbide inserts or the like for cutting rock formation in a conventional manner.

In the longitudinal cross section of FIG. 2 the right hand arm is illustrated in its retracted position with its cutter 16 in an open pocket 17 in the lower body. The left hand arm is illustrated in its extended position with its cutter protruding laterally from the lower body for reaming surrounding rock formation. In the upper half of FIG. 2 (illustrated at the left on the sheet of drawings) the internal operating mechanism is illustrated as if split along the center line. To the right of the center line the mechanism is illustrated in an upper position corresponding to the retracted position of the right hand cutter arm. The left hand portion of the operating mechanism is illustrated in a lower position corresponding to the extended position of the left hand arm. In the lower half of FIG. 2 the operating mechanism is illustrated only in the lower position since the operation of that portion is similar to that described and illustrated in the above-mentioned U.S. patents and limited repetition of that disclosure is desirable.

The cutter arms 14 are mounted on the lower body by a cylindrical hinge pin 18. Each cutter arm has a lower portion on which the cutter 16 is mounted and an upper follower portion 19 which is half the width of the lower portion. The two arms are mounted on the hinge pin in a scissors fashion. The half width portions of the cutter arms are on opposite sides of the center line of the underreamer and can swing past each other so that the two arms swing in opposite direction.

The hinge pin is held in the lower body by an assembly comprising an inner disk-like seat 21 and an outer disk-like cap 22. The seat 21 has a threaded hole for receiving a cap screw 23. The cap screw extends through the cap for bolting the cap and seat together. A pin 24 prevents the seat and cap from rotating relative to the lower body, thereby permitting tightening of the cap screw. An almost full-circle bail wire 26 extends around a circumferential V-shaped groove at the interface of the cap and seal. Tightening of the cap screw pulls the cap and seal together and cams the bail wire radially outwardly into a shallow groove in the lower body. The bail wire, partly in the body groove and partly in the groove between the seat and cap, prevents the assembly from coming out of the lower body, thereby holding the hinge pin in place. The hinge pin has a tapped hole 27 in one end for receiving a tool for pulling the hinge pin from the body for disassembly of the underreamer.

A pair of rectangular arm stop lugs 28 are bolted to the lower body above the pocket 17 in which the arms are fitted. The stop lugs limit the pivoting of the arms toward the extended position thereby determining the diameter of the hole that is reamed. They also transmit load from the body to the arms when reaming. Different arm configurations can be used for obtaining a desired reaming diameter.

The arms are actuated by an axially extending camming plunger 29. The upper end of the plunger is threaded into a piston 31. The plunger is maintained in a fixed rotational orientation in the lower body by a pair of guide pins 32 which extend into longitudinal slots 33 on opposite sides of the plunger. At the lower end of the camming plunger there are a pair of opposite diagonal cam faces 34, only one of which can be seen in the illustration of FIG. 2. The hidden cam face is the same as the one illustrated and faces in the opposite direction. Each cam face engages the half width follower portion 19 of one of the arms. When the camming plunger is in its upper position the cam faces are clear of the upper ends of the arms and the arms are free to pivot toward their retracted position. When the camming plunger moves downwardly the cam faces engage the curved faces of the upper follower portion 19 on the arms, thereby spreading them apart and camming the arms in opposite directions toward their extended underreaming position.

The piston 31 at the upper end of the camming plunger is sealed to a sleeve 35 by an upper packing ring 36. A narrow saw cut 40 in the side of the piston extends across the groove in which a lower packing ring 37 is fitted. Thus, the lower packing ring is not sealed to the piston and serves as a wiper to assure that the sealing surface in the sleeve is clean when the piston moves downwardly. The piston is solid; that is, it does not have an axial passage through which drilling mud flows when the underreamer is used. The piston is biased toward its upper (retracted) position by a coil spring 43 in an annular chamber beneath the piston.

The lower end of the sleeve 35 is secured to the lower body 10 by the plunger guide pins 32. For a major portion of its length the outside diameter of the sleeve is less than the inside diameter of the tubular upper body 11, thereby leaving an open fluid flow annulus 38 between the sleeve and upper body. The upper portion of the sleeve is sealed to the upper body by an O-ring 39. The lower end of the sleeve is sealed to the lower body by O-rings 41. The lower end of the annulus is also closed by an O-ring 42. These O-rings prevent flow of drilling mud through unwanted leakage paths to minimize erosion of the various parts of the underreamer.

A plurality of openings 46 are provided through the wall of the sleeve above the piston, thereby permitting communication of drilling fluid between the interior of the drill string and the annulus 38 between the sleeve and upper body. Drilling fluid can then flow downwardly through the lower body, through six parallel longitudinal passages 47 and 48. Two fluid passages 47 extend through the lower body past the pocket 17 into which the cutters retract, and discharge into the central opening of the lower body above the lower box 13. This bypassing of fluid through the lower body can be used for delivering drilling mud to a rock drill bit or the like connected to the lower end of the underreamer.

The other four passages 48 terminate in nozzle orifices 49 (FIG. 1) adjacent the cutters. The nozzles direct drilling mud from two of the passages into the space around the lower body adjacent to the cutters in their extended position. The other two nozzles discharge drilling mud into the pocket 17 in the lower body for keeping the pocket clear of chips or the like that might inhibit retraction of the cutters.

In other varieties of underreamers, drilling mud is ordinarily conveyed to the region of the cutters through an axial passage through a piston which actuates the cutter arms. Because of the scissor mounting of the cutter arms in this embodiment of underreamer, other ways of conveying fluid through the underreamer are employed. The arrangement using a sleeve for the piston, with drilling mud flowing through the annulus between the sleeve and upper body, avoids wash-out of the steel parts of the underreamer by the erosive drilling fluid, permits easy assembly and disassembly of the underreamer and provides for delivery of drilling mud where required during use of the underreamer.

When the underreamer is used, drilling mud is pumped down the inside of the drill string that supports the underreamer, and returns uphole in the annulus between the drill string and the well bore. The hydraulic pressure inside the underreamer is greater than the hydraulic pressure outside the underreamer because of the pressure drop at the nozzles 49 and elsewhere. This pressure difference, along with the difference in diameters of the upper end of the piston 31 and the lower end of the camming plunger 29, results in application of a hydraulic force tending to shift the piston towards its lower (extended) position.

Thus, to extend the arms from the retracted to the extended position, drilling mud is pumped down the drill string. This causes the piston to move downwardly from the upper position illustrated on the right of FIG. 2 to the lower position illustrated on the left of FIG. 2. This compresses the coil spring 43 and, more significantly, cams the pivotable arms outwardly to the extended underreaming position. A flat (not shown) is cut on a side of the camming plunger to permit discharge of fluid from the chamber in which the coil spring 43 is positioned.

To recapitulate, when the underreamer is used, it is lowered through the hole with the cutter arms retracted and the piston in its upper position. When the desired elevation in the well is reached, drilling mud is pumped down the drill string. Such mud flows through the openings in the sleeve into the annulus 38 between the sleeve and upper body, and then through the passages through the lower body to be discharged through nozzles adjacent the cutters and into the open lower end of the underreamer for use with a rock drill or the like.

The hydraulic pressure gradient so established displaces the piston and camming plunger downwardly, camming the cutter arms toward their extended underreaming position. During reaming, weight of the drill string applied to the upper end of the underreamer is transmitted to the cutter arms by way of the stop lugs 28. When the desired underreaming is complete, circulation of drilling mud is discontinued and the underreamer is lifted slightly. Release of the hydraulic pressure permits the coil spring to return the piston and plunger from the lower position to the upper position. This releases the cam faces from the follower portions of the arms, thereby permitting the arms to pivot back into the pocket in the lower body for withdrawal of the underreamer from the well. In the event the arms do not fully retract by gravity, withdrawing the underreamer to the upper smaller diameter portion of the hole applies a force against the outside of the arms tending to push them toward the retracted position. If the piston has not travelled to its uppermost position to permit full retraction solely by action of the spring, the follower portions of the arms cam the plunger and piston toward that upper position.

By bringing the drilling mud through the lower body instead of through the piston, the mud can be discharged into the bore hole in desirable locations adjacent to the cutters instead of just into the cutter pocket. It also becomes straightforward to deliver drilling mud to a rock bit attached below the underreamer. The cross section of the portions of the underreamer through which the drilling mud flows can be kept large so that flow velocity is low and erosion is minimized.

Many modifications and variations of this invention will be apparent to those skilled in the art. Thus, for example, a passage can be provided through the lower body portion to communicate with an end of the hinge pin. In such an embodiment a hollow hinge pin can be used with fluid passages through the arms so that drilling mud can be discharged through the arms or cutters as desired. In another embodiment the camming plunger and piston can be integral instead of threaded together. Many other variations can be devised. It is therefore to be understood that within the scope of the appended claims, this invention may be practiced outerwise than as specifically described.

What is claimed is:

1. An underreamer comprising:

a lower body;

a plurality of cutter arms mounted in the lower body for pivoting between a retracted position and an extended underreaming position;

a tubular upper body connected above the lower body;

a sleeve within the upper body and fixed to the lower body, at least a portion of the sleeve having an outside diameter sufficiently smaller than the inside diameter of the upper body to leave a fluid flow annulus between the sleeve and upper body;

a solid piston in the sleeve axially shiftable from an upper position to a lower position in response to application of fluid pressure;

means connected to the piston for pivoting the cutter arms from the retracted position toward the extended position when the piston shifts toward the lower position; and passage means through the lower body for conveying fluid through at least a portion of the lower body from the annulus between the upper body and the sleeve.

2. An underreamer as recited in claim 1 wherein the passage means comprises nozzles for discharging fluid from the lower body adjacent to the cutter arms.

3. An underreamer as recited in claim 2 wherein the passage means comprises a plurality of non-axial longitudinal passages through the lower body between the annulus and the nozzles.

4. An underreamer as recited in claim 2 comprising passage means for discharging fluid through the lower end of the lower body.

5. An underreamer as recited in claim 1 further comprising a plurality of openings through the sleeve above the piston for conveying fluid from within the sleeve to the annulus between the sleeve and the upper body.

6. An underreamer as recited in claim 1 wherein a pair of cutter arms are pivotally mounted on a single hinge pin for scissoring between the extended and retracted positions, and further comprising a pair of opposed cam faces connected to the piston for camming the pair of arms in opposite directions from the retracted position toward the extended position.

7. An underreamer comprising:

a lower body;

a plurality of cutter arms mounted in the lower body for pivoting between a retracted position and an extended underreaming position;

a tubular upper body connected above the lower body;

a sleeve within the upper body and fixed to the lower body, at least a portion of the sleeve having an outside diameter sufficiently smaller than the inside diameter of the upper body to leave a fluid flow annulus between the sleeve and upper body;

a piston in the sleeve axially shiftable from an upper position to a lower position in response to application of fluid pressure;

means connected to the piston for pivoting the cutter arms from the retracted position toward the extended position when the piston shifts toward the lower position; and passage means through the lower body for conveying fluid through at least a portion of the lower body from the annulus between the upper body and the sleeve including at least one means for discharging fluid outside the lower body adjacent to a cutter arm in its extended position and at leat one means for discharging fluid into a pocket occupied by the cutter arms in their retracted position.

8. An underreamer as recited in claim 7 comprising passage means for discharging fluid through the lower end of the lower body.

9. An underreamer as recited in claim 1 comprising guide means for preventing rotation while permitting translation of the piston, and wherein the guide means also secures the sleeve to the lower body.

10. An underreamer comprising:

a lower body;

a tubular upper body connected above the lower body;

means on the upper body for connecting the underreamer to a drill string;

a transverse hinge pin in the lower body;

a pair of cutter arms scissor mounted on the hinge pin for pivoting between a retracted position in a pocket in the lower body and an extended position protruding in part laterally from the lower body;

a cutter mounted on each of the cutter arms;

a solid axial piston in the upper body movable from an upper position toward a lower position in response to application of fluid pressure from such a drill string;

a spring beneath the piston for resiliently biasing the piston toward the upper position;

a camming plunger connected to the piston including opposing diagonal cam faces on the lower end of the plunger for engaging an upper portion of each of the arms for camming the lower portion of the arms from the retracted position toward the extended position in response to downward movement of the piston;

means for preventing rotational movement of the camming plunger;

a sleeve extending through a portion of the upper body and surrounding the piston;

an annulus between the sleeve and upper body;

means for sealing the piston inside the sleeve;

means for passing fluid from within the sleeve to the annulus between the sleeve and the upper body for bypassing fluid around the piston in the upper body to the lower body; and non-axial passage means through the lower body in communication with the annulus between the sleeve and upper body for receiving fluid from the upper body and discharging fluid adjacent to the cutters.

11. An underreamer as recited in claim 10 wherein the passage means discharges at least a portion of the fluid outside the lower body adjacent to a cutter arm in its extended position and at least a portion of the fluid into a pocket occupied by the cutter arms in their retracted position.

12. An underreamer comprising:

a lower body;

a tubular upper body connected above the lower body;

means on the upper body for connecting the underreamer to a drill string;

a transverse hinge pin in the lower body;

a pair of cutter arms scissor mounted on the hinge pin for pivoting between a retracted position in a pocket in the lower body and an extended position protruding in part laterally from the lower body;

a cutter mounted on each of the cutter arms;

an axial piston movable form an upper position toward a lower position in response to application of fluid pressure from such a drill string;

means for resiliently biasing the piston toward the upper position;

a camming plunger connected to the piston including opposing diagonal cam faces on the lower end of the plunger for engaging an upper portion of each of the arms for camming the lower portion of the arms from the retracted position toward the extended position in response to downward movement of the piston;

at least one longitudinally extending slot in the camming plunger;

a guide pin in the lower body having an end in such a slot for permitting longitudinal motion of the camming plunger and preventing rotational movement of the camming plunger;

a sleeve secured to the lower body and extending upwardly into the upper body and surrounding the piston, the sleeve having a smaller outside diameter than at least a portion of the inside diameter of the upper body for defining a fluid flow annulus between the sleeve and upper body;

means for sealing the piston inside the sleeve;

a plurality of openings through the sleeve for passing fluid from within the sleeve to the annulus between the sleeve and the upper body;

a plurality of parallel longitudinally extending non-axial passages through the lower body for receiving fluid from the annulus between the sleeve and upper body and discharging fluid adjacent to the cutters; and additional passage means for conveying fluid from the annulus between the sleeve and upper body to the lower end of the lower body.

13. An underreamer as recited in claim 12 wherein the guide pin extends through a hole in the lower end of the sleeve for securing the sleeve to the lower body, the spring means comprises a coil spring in a chamber between the piston and the sleeve, and comprising means for discharging fluid from the spring chamber.

14. An underreamer as recited in claim 10 wherein the passage means through the lower body also discharges fluid through the lower end of the lower body.

* * * * *